United States Patent [19]

Tanaka

[11] Patent Number: 4,546,350

[45] Date of Patent: Oct. 8, 1985

[54] DISPLAY APPARATUS

[75] Inventor: Kazuyuki Tanaka, Kamakura, Japan

[73] Assignee: Matsushita Electric Industrial Co., Ltd., Osaka, Japan

[21] Appl. No.: 374,775

[22] Filed: May 4, 1982

[30] Foreign Application Priority Data

May 13, 1981 [JP] Japan ..... 56-71703

[51] Int. Cl.[4] ..... G09G 1/16

[52] U.S. Cl. ..... 340/750; 340/731; 340/744; 340/814

[58] Field of Search ..... 340/731, 749, 723, 748, 340/744, 750, 814, 811

[56] References Cited

U.S. PATENT DOCUMENTS

| | | | |
|---|---|---|---|
| 4,012,592 | 3/1977 | Ricard | 340/749 |
| 4,087,808 | 5/1978 | Herndon, Jr. | 340/749 |
| 4,107,786 | 8/1978 | Masaki et al. | 340/731 |
| 4,430,649 | 2/1984 | Leininger | 340/731 |

*Primary Examiner*—Marshall M. Curtis

*Attorney, Agent, or Firm*—Stevens, Davis, Miller & Mosher

[57] ABSTRACT

An improved timing signal generating circuit for use in a raster-scanning CRT display apparatus. The circuit provides timing signals including memory control signals and clocks for the screen memory which stores data for characters and graphic patterns to be displayed on the CRT display unit, the CRT control circuit which supplies the synchronizing signal to the display unit and supplies the display address signal to the screen memory, and the processing circuit which reads and writes the screen memory. The timing signal generating circuit comprises a counter for dividing the frequency of the original oscillation signal, a first memory device which receives at its address terminal the output of the counter, and a second memory device which receives at its input terminal the output of the first memory device and stores it in response to the original oscillation signal whereby to provide outputs as the timing signals.

7 Claims, 8 Drawing Figures

| | | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|---|
| ADDRESS | $A_1$ | 0 | 1 | 0 | 1 | 0 | 1 | 0 | 1 | 0 | 1 | 0 | 1 | 0 | 1 | 0 | 1 |
| | $A_2$ | 0 | 0 | 1 | 1 | 0 | 0 | 1 | 1 | 0 | 0 | 1 | 1 | 0 | 0 | 1 | 1 |
| | $A_3$ | 0 | 0 | 0 | 0 | 1 | 1 | 1 | 1 | 0 | 0 | 0 | 0 | 1 | 1 | 1 | 1 |
| | $A_4$ | 0 | 0 | 0 | 0 | 0 | 0 | 0 | 0 | 1 | 1 | 1 | 1 | 1 | 1 | 1 | 1 |
| | $A_5$ | 0 | 0 | 0 | 0 | 0 | 0 | 0 | 0 | 0 | 0 | 0 | 0 | 0 | 0 | 0 | 0 |
| DATA | $O_1$ | 1 | 1 | 0 | 0 | 0 | 0 | 0 | 1 | 1 | 1 | 0 | 0 | 0 | 0 | 0 | 1 |
| | $O_2$ | 1 | 0 | 0 | 0 | 0 | 0 | 0 | 1 | 1 | 0 | 0 | 0 | 0 | 0 | 0 | 1 |
| | $O_3$ | 1 | 1 | 1 | 1 | 1 | 1 | 1 | 0 | 0 | 0 | 0 | 0 | 0 | 0 | 0 | 1 |
| | $O_4$ | 0 | 0 | 0 | 0 | 0 | 0 | 0 | 1 | 1 | 1 | 1 | 1 | 1 | 1 | 1 | 0 |
| | $O_5$ | 1 | 1 | 1 | 1 | 1 | 1 | 1 | 1 | 1 | 1 | 1 | 1 | 1 | 1 | 0 | 1 |
| | $O_6$ | X | X | X | X | X | X | X | X | X | X | X | X | X | X | X | X |
| | $O_7$ | X | X | X | X | X | X | X | X | X | X | X | X | X | X | X | X |
| | $O_8$ | X | X | X | X | X | X | X | X | X | X | X | X | X | X | X | X |

X = TO FILL DATA IF NECESSARY

DISPLAY APPARATUS

BACKGROUND OF THE INVENTION

1. Field of the Invention

The present invention relates to a display apparatus using a raster-scanning type cathode-ray tube, and more specifically, to a timing signal generating circuit for the display apparatus.

2. Description of the Prior Art

In the prior art display apparatus using a raster scanning type CRT and including a screen memory for storing data for characters and graphic patterns to be displayed on the CRT, a CRT control circuit which supplies synchronizing signals to the CRT and provides the screen memory with the address for the display position on the CRT screen, and a processing circuit (CPU) for reading and writing the screen memory, a timing signal generating circuit for generating timing signals for controlling the operations of the various component circuits is formed by a logic circuit including a combination of gates. As a result, for varying the timings, it is necessary to vary the combinations of gates.

SUMMARY OF THE INVENTION

It is an object of the present invention to provide a display apparatus in which timing of operations can be varied arbitrarily.

Another object of the present invention is to provide a display apparatus having a relatively simple timing signal generating circuit.

DESCRIPTION OF THE PREFERRED EMBODIMENT

Figure 1:
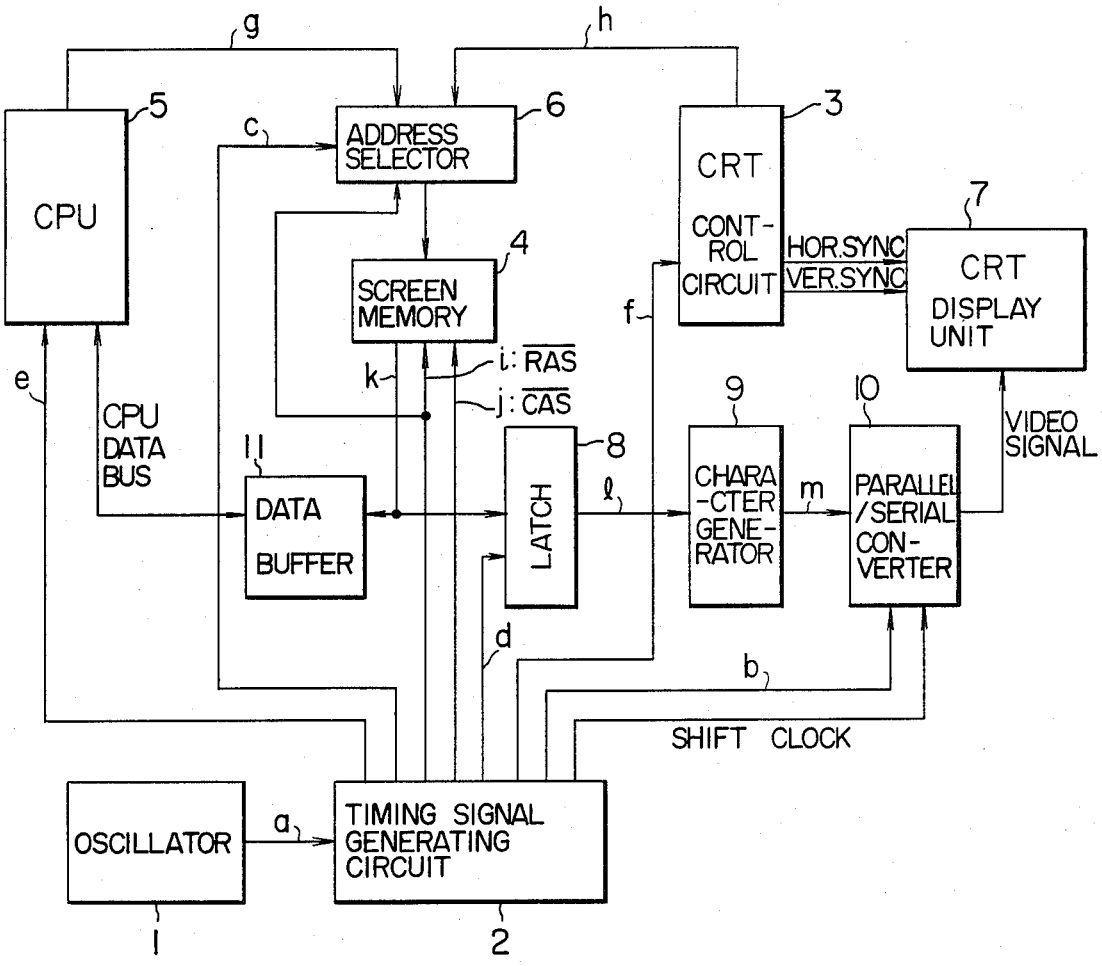
FIG. 1 is a block diagram showing the general arrangement of the display apparatus.
Figure 2:
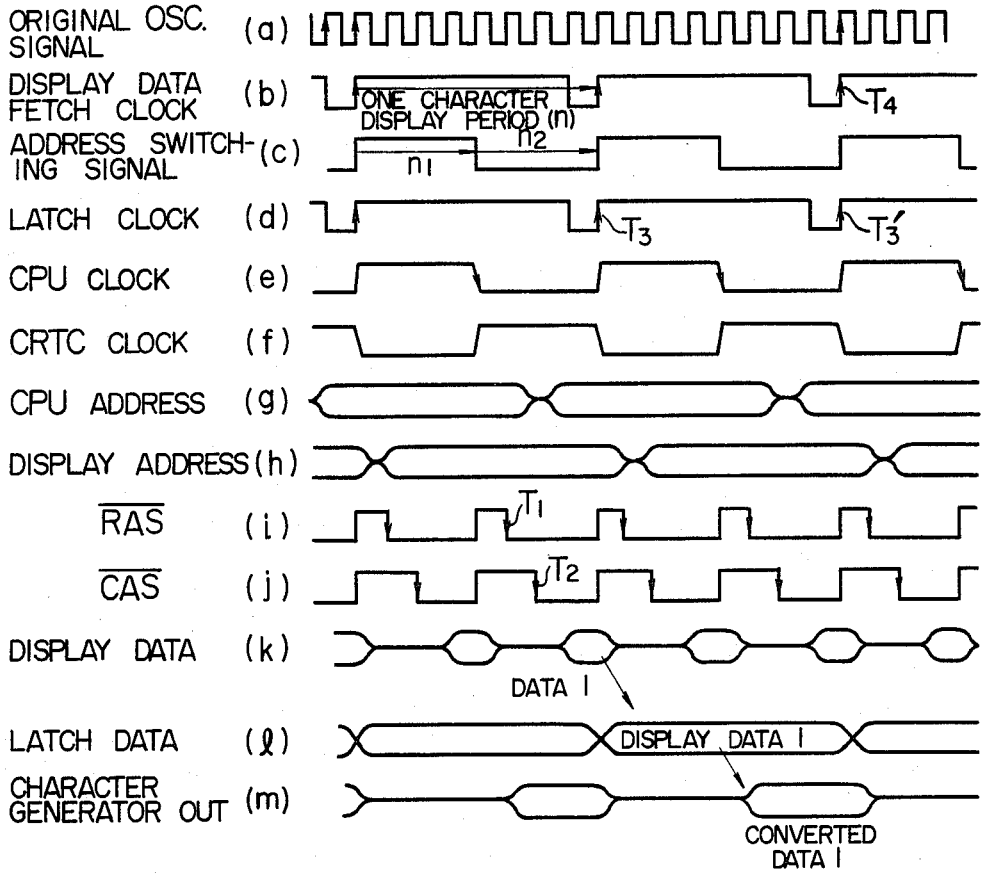
FIG. 2 is a timing chart for the apparatus shown in FIG. 1.
Figure 3:
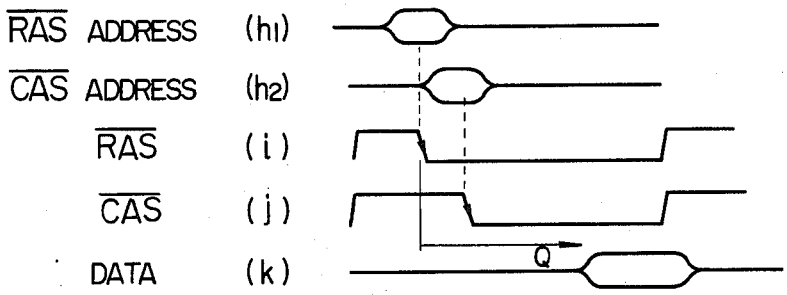
FIG. 3 is a timing chart for the dynamic memory used as the screen memory.

FIG. 1 shows in block diagram the general arrangement of the display apparatus, and FIG. 2 shows the timing chart useful to explain the operation of the apparatus.

In FIG. 1, reference number 1 denotes an original oscillator which provides an original oscillation signal having a maximum frequency for the apparatus. A timing signal generating circuit 2 provides the timing of operations of the apparatus in response to the original oscillation signal a from the oscillator 1. A CRT control circuit 3 generates an address for the display position on the screen of a CRT display unit 7 and also generates horizontal and vertical synchronizing signals supplied to the CRT display unit 7. A screen memory 4 stores data for characters to be displayed on the CRT screen of the CRT display unit 7. A processing circuit (CPU) 5 reads and writes the screen memory 4 so as to compose sentences on the screen. An address selector 6 conducts selectively the display address h delivered from the CRT control circuit 3 and a CPU address g delivered from the CPU 5 to the screen memory 4 in response to an address switching signal c and a timing signal $\overline{RAS}$-i. The display unit 7 has a CRT of the raster scanning type. A latch circuit 8 temporarily stores display data k read out of the screen memory 4. A character generator 9 converts an output signal of the latch 8 (latched display data l) into bit data for characters to be displayed on the CRT screen. A parallel-to-serial converter 10 receives display data m from the character generator 9 in response to a display data fetch clock b, then converts the data into serial data in response to a shift clock so as to form a video signal. A data buffer 11 serves to connect the CPU 5 to a data bus of the screen memory 4 when the CPU 5 makes access to the screen memory 4.

Operation of the foregoing arrangement will be described briefly with reference to FIG. 2. The CRT control circuit 3 shown in FIG. 1 issues the display address h to the screen memory 4 via the address selector 6 when the address switching signal c is low, i.e., during the period $n_2$ in FIG. 2.

Assuming that an inexpensive dynamic memory is employed as the screen memory 4, the memory receives an $\overline{RAS}$ address at a negative-going transition of an $\overline{RAS}$ signal i and a $\overline{CAS}$ address at a negative-going transition of a $\overline{CAS}$ j, thereby providing data corresponding to these addresses upon expiration of a certain access time Q.

The display address h is given to the screen memory 4 via the address selector 6 which is controlled by the address switching signals c and i ($\overline{RAS}$), so that the $\overline{RAS}$ address is given to the screen memory 4 in the timing of $T_1$ and the $\overline{CAS}$ address is given in the timing of $T_2$. The screen memory 4 outputs display data k corresponding to the display address. The latch circuit 8 holds the display data k in the timing of $T_3$ as shown by a waveform l, and supplies the latched display data l to the character generator 9 until the next latch time $T_3'$. The character generator 9 carries out bit conversion for the supplied display data l and outputs converted data m. The parallel-to-serial converter 10 receives the converted data m in the timing of $T_4$ and converts it into a serial video signal to be supplied to the display unit 7 in response to the original oscillation signal a.

On the other hand, the CPU 5 reads and writes the screen memory 4 when the address switching signal c is high (during the period $n_1$) in the timing relationship similar to the case of the CRT control circuit 3. The CRT control circuit 3 counts a CRT control clock f to provide the display address representing the display position on the CRT screen, and also supplies the horizontal and vertical sync signals to the display unit 7.

The timing signal generating circuit 2 according to the present invention provides the address switching signal c, display data fetch clock b, latch clock d, CPU clock e, CRTC operating clock f, $\overline{RAS}$ signal, and $\overline{CAS}$ signal which serve to time the foregoing operations.

Figure 4:
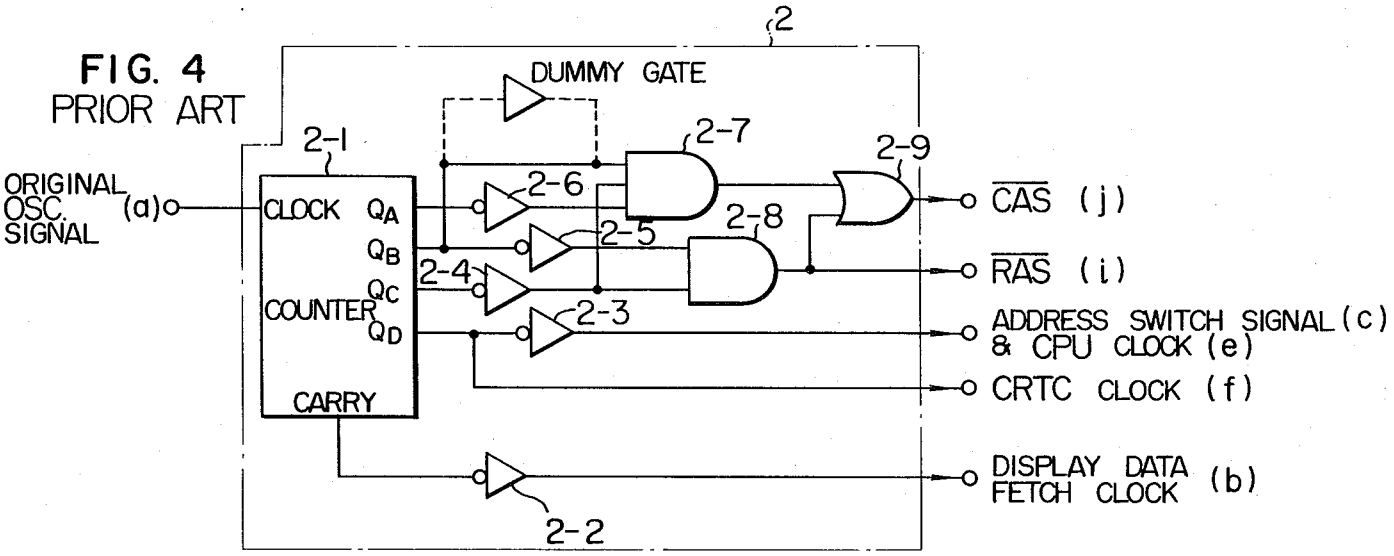
FIG. 4 PRIOR ART
FIG. 4 is a circuit diagram of the conventional timing signal generating circuit.

FIG. 4 shows an example of the conventional timing signal generating circuit 2, which includes a binary counter 2-1, inverters 2-2, 2-3, 2-4, 2-5, and 2-6, AND gates 2-7 and 2-8, and OR gate 2-9. Operation of the circuit will be described in connection with the timing chart shown in FIG. 5.

First, the binary conuter 2-1 counts the original oscillation signal a to provide outputs QA, QB, QC, and QD having divided frequencies and a CARRY output. The $\overline{RAS}$ signal (i) is produced from these signals in accordance with the Boolean expression:

$$\overline{RAS} = \overline{QB} \cdot \overline{QC} \cdot \overline{QD} + \overline{QB} \cdot \overline{QC} \cdot QD \quad (1)$$

$$= \overline{QB} \cdot \overline{QC}$$

Similarly, the $\overline{CAS}$ signal (j) is obtained by $$\overline{CAS} = \overline{RAS} + \overline{QA} \cdot QB \cdot \overline{QC} \cdot \overline{QD} + \overline{QA} \cdot QB \cdot \overline{QC} \cdot QD \quad (2)$$

$$= \overline{RAS} + \overline{QA} \cdot QB \cdot \overline{QC}$$

The CPU clock e and address switching signal c are:

$$c = e \quad (3)$$

$$= \overline{QD}$$

The CRT control circuit operating clock f is:

$$f = QD \ldots \quad (4)$$

The display fetch clock b is expressed as:

$$b = CARRY \ldots \quad (5)$$

These Boolean expressions are realized by the logic circuit shown in FIG. 4. However, this logic circuit has the following disadvantages.

Figure 5:
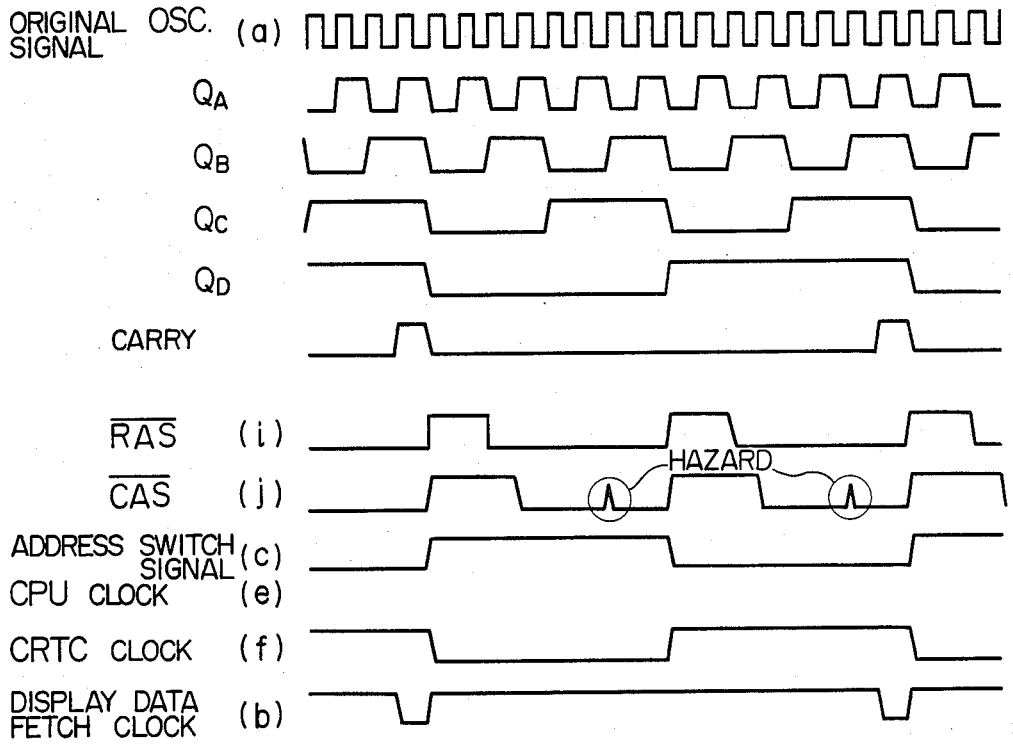
FIG. 5 PRIOR ART
FIG. 5 is a timing chart for the circuit shown in FIG. 4.

(1) The AND gate 2-7 receives the three inputs from the counter 2-1 through the different propagation stages, causing a hazard in the $\overline{CAS}$ output (j in FIG. 5). Therefore, it needs a precise timing consideration in designing the gate circuit, such as providing a dummy gate between the counter 2-1 and the AND gate 2-7.

(2) Since the timing circuit is designed using logic gates, any alteration of timing requires a reconsideration of Boolean expressions, a change in the logic circuit design and a change in the printed wiring board, thus making it difficult to change the timing.

Figure 6:
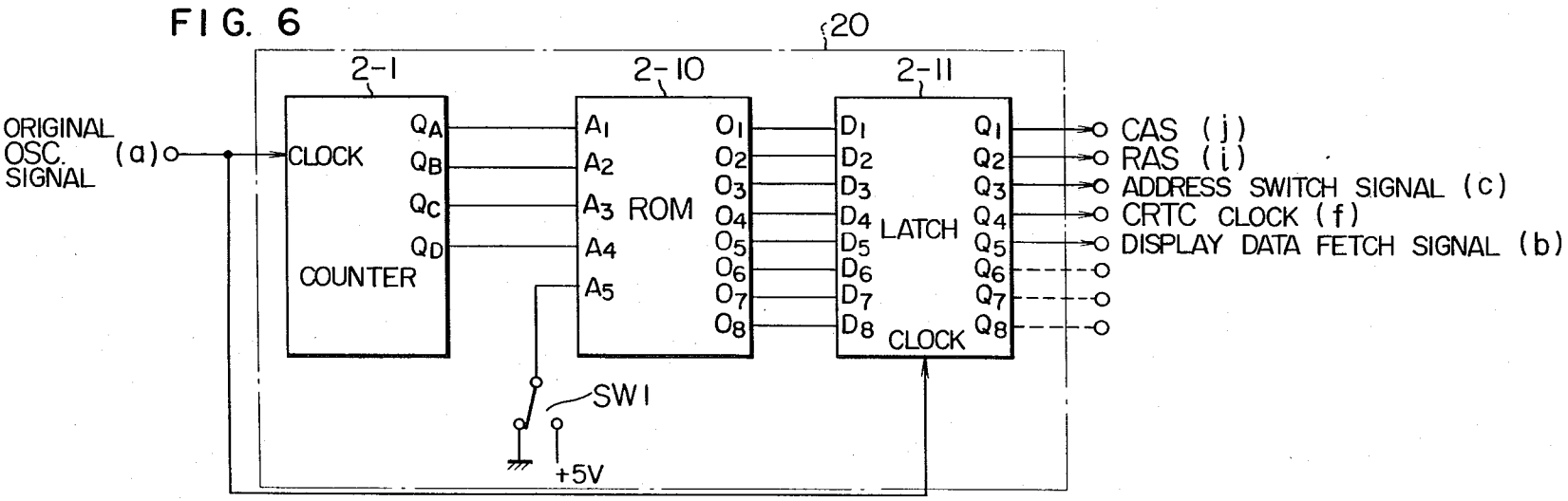
FIG. 6 is a circuit diagram of the timing signal generating circuit used in the display apparatus embodying the present invention.

The present invention contemperates to solve these problems. FIG. 6 shows an example of the timing signal generating circuit 20 according to the present invention. The circuit includes a binary counter 2-1, a read only memory (ROM) 2-10 and a latch 2-11.

The circuit of FIG. 6 will now be described with reference to the timing chart shown in FIG. 7. The binary counter 2-1 counts the original oscillation signal a to deliver frequence-divided outputs QA, QB, QC and QD to the address input terminals of the ROM 2-10. The ROM 2-10 oututs data $O_1$, $O_2$, $O_3$, $O_4$, $O_5$, $O_6$, $O_7$ and $O_8$ corresponding to the inputted address $A_1$, $A_2$, $A_3$ and $A_4$. The latch 2-11 stores the output data $O_1$-- $O_8$ at timing of the original oscillation signal and outputs the timing signals corresponding to the data through the output terminal $Q_1$-$Q_8$.

Figures 7, 8:
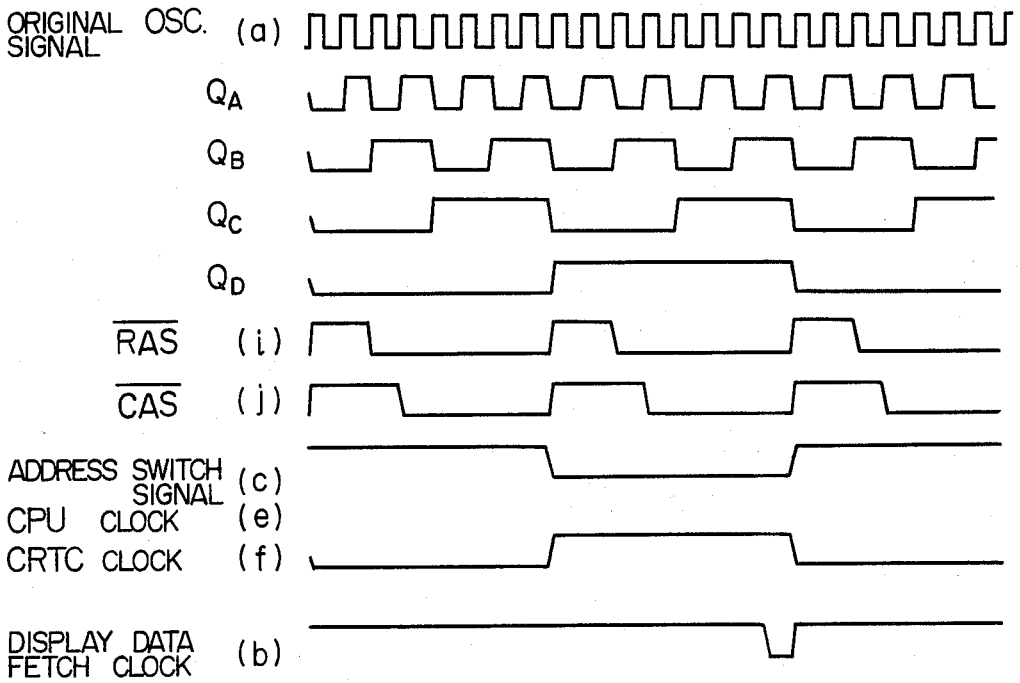
FIG. 7 is a timing chart for the circuit shown in FIG. 6.
FIG. 8 shows an example of data stored in the read only memory (ROM) for providing the timing shown in FIG. 7.

It will be understood that this circuit arrangement provides the timing signals $\overline{RAS}$ and $\overline{CAS}$, address switching signal c, CPU clock e, CRT control circuit operating clock f and display data fetch clock b shown in FIG. 7 by provision of data, as shown in FIG. 8, stored in the ROM 2-10. Referring to FIG. 8, for example, timing data of rows of $O_1$, $O_2$, $O_3$ . . . correspond respectively to timing signals $\overline{CAS}$ (j), $\overline{RAS}$ (i), ADDRESS SWITCH SIGNAL (c) . . . etc., in FIG. 7. In FIG. 8, data precedes by one address interval, since it is delayed by one clock interval in the latch 2-11. A switch $SW_1$ in FIG. 6 is used to change the ROM address for changing the timing functions of FIG. 8 instantaneously.

The arrangement of FIG. 6 does not necessitate the consideration of the number of gating stages and logical design using Boolean expressions. The timing function can be altered arbitrarily by using the switch $SW_1$ or by replacing the ROM 2-10. Therefore, alteration of timing does not require the modification of the printed wiring board, resulting in a reduction of developing time and also in a reliable operation. When the ROM 2-10 is replaced with a random access memory (RAM), timing data can be programmed by software whereby to alter the timing function arbitrarily as in the case of the foregoing arrangement.

The latch 2-11 serves to eliminate hazards included in the output of the ROM 2-10, and it can be replaced with a memory, J-K flip-flops or R-S flip-flops. The ROM 2-10 may be of a MOS-EPROM with the original oscillation signal having a lower frequency, and may be of a bipolar ROM with the original oscillation signal having a higher frequency around 20 MHz. In addition, the timing selector switch $SW_1$ advantageously allows an instantaneous switching for several timing functions.

I claim:

1. A display apparatus comprising:

a display means including a cathode ray tube (CRT) of the raster scanning type;

a screen memory for storing data to be displayed on said display means;

a CRT control circuit for supplying a synchronizing signal to said display means and supplying a display address signal which corresponds to a display position on the CRT screen to said screen memory;

a processing circuit for reading to and writing from said screen memory; and a timing signal generating circuit for providing timing signals including (a) an operating clock signal for said CRT control circuit, (b) a clock signal for said processing circuit and (c) control signals for timing the read-out of display data from said screen memory, said timing signal generating circuit comprising means for dividing a frequency of an applied oscillating signal to produce a plurality of different frequency signals, memory means having address input terminals and data output terminals, said memory means storing data representing said timing signals and receiving at respective address input terminals said plurality of different frequency signals, said memory means supplying said stored data at said output terminals in response to said plurality of different frequency signals applied to said address input terminals, and a latching means for eliminating changes in the data at said output terminals of said memory means when said frequency dividing means changes state by storing data at the data output terminals of said memory means and by supplying said stored data to said CRT control circuit, said processing circuit and said screen memory, respectively, as said timing signals in response to said applied oscillating signal.

2. A display apparatus according to claim 1 wherein said memory means is a read only memory.

3. A display apparatus according to claim 1 wherein said memory means is a random access memory.

4. A display apparatus according to claim 1 wherein at least one of said address input terminals is connected to a switch means for applying a signal of a selected logic level thereto.

5. A display apparatus according to claim 1, further comprising:

address selector means for receiving the display address signal supplied from said CRT control circuit and for receiving a CPU address signal supplied from said processing circuit and for selectively transmitting the received address signals to respective address terminals of said screem memory in response to one of said timing signals provided by said timing signal generating circuit;

a character generator having address terminals for receiving display data signals from said screen memory and for generating parallel character data signals; and a parallel to serial converter, responsive to at least one of said timing signals for receiving the character data signals and converting the received data signals into a serial video signal to be applied to said cathode ray tube.

6. A display apparatus according to claim 1 wherein said screen memory is a dynamic memory.

7. A timing signal generating circuit for generating timing signals for use in operating a display apparatus comprising:

means for dividing a frequency of an applied oscillating signal to produce at a plurality of different frequency signals;

memory means having address input terminals and data output terminals, said memory means storing data representing said timing signals and receiving at respective address input terminals said plurality of different frequency signals, said memory means supplying said stored data representing said timing signals at said output terminals in response to said plurality of different frequency signals applied to said address input termimals; and, latching means for eliminating changes in the data at said output terminals of said memory means when said frequencey dividing means changes state by storing data at the date output terminals of said memory means in response to said applied oscillating signal.

* * * * *